US005523822A

United States Patent [19]

Tsuda

[11] Patent Number: 5,523,822

[45] Date of Patent: Jun. 4, 1996

[54] IMAGE FORMING APPARATUS WITH MEANS OF SELECTING A PAPER CASSETTE THAT HAS JUST BEEN LOADED

[75] Inventor: Kenichi Tsuda, Yokosuka, Japan

[73] Assignee: Kabushiki Kaisha Toshiba, Kawasaki, Japan

[21] Appl. No.: 209,197

[22] Filed: Mar. 10, 1994

[30] Foreign Application Priority Data

Mar. 22, 1993 [JP] Japan ..... 5-061796

[51] Int. Cl.[6] ..... G03G 21/00

[52] U.S. Cl. ..... 355/208; 271/9.03; 355/308

[58] Field of Search ..... 355/208, 209, 355/308, 309; 271/9, 145, 9.02, 9.03

[56] References Cited

U.S. PATENT DOCUMENTS 4,734,747 3/1988 Okuda et al. ..... 355/308
4,804,997 2/1989 Mizude et al. ..... 355/311
5,357,329 10/1994 Ariyama et al. ..... 355/309

FOREIGN PATENT DOCUMENTS 58-116551 7/1983 Japan .
2-30974 7/1990 Japan .

*Primary Examiner*—Nestor R. Ramirez
*Attorney, Agent, or Firm*—Limbach & Limbach

[57] ABSTRACT

An electrostatic copying machine has a cassette detachment detection circuit. The detection circuit detects a detachment of any one of a plurality of cassettes. When one of the plurality of paper cassettes is taken out of the main body of the copying machine and returned to the original position by the detection circuit, the returned cassette is automatically selected for supplying papers therefrom. The residual of the papers of the cassette which is taken out of the main body is checked by a paper remainder detection circuit. In a case that, when the residual of the papers in the returned cassette is not a predetermined value, the operability of the copying machine can be improved since the cassette is returned to the main body and the paper is supplied from the returned cassette.

3 Claims, 8 Drawing Sheets

| SIZE OF PAPER IN CASSETTE | ARRAY OF CONTACT MAKERS | | | |
|---|---|---|---|---|
| | a | b | c | d |
| LETTER | | | | ■ |
| A 4 | | | ■ | |
| A 4 R | | | ■ | ■ |
| LEGAL | | ■ | | |
| 11 X 17 | | ■ | | ■ |
| 10 X 15 | | ■ | ■ | |
| 8 1/2 X 11 | ■ | | | |
| 11 X 8 1/2 | ■ | | | ■ |
| | | | | |
| COMPUTER | ■ | | ■ | |

■ SHOWS A CONTACT MAKER

FIG. 6

IMAGE FORMING APPARATUS WITH MEANS OF SELECTING A PAPER CASSETTE THAT HAS JUST BEEN LOADED

BACKGROUND OF THE INVENTION

1. Field of the Invention

This invention relates to an image forming apparatus wherein an image on a document is converted to an electrostatic latent image by an electrostatic image forming process and the latent image is developed by toner, and a toner image is printed out on a sheet material.

2. Description of the Related Art

An image forming apparatus, e.g., a copying machine, has an image reading section for reading an image on a document, an image forming section for forming an image read by the image reading section, and a material transporting section for transporting sheet materials to output a toner image formed by the image forming section.

The reading section has a document table on which a document is mounted, reads image data of the image on the document, and transmits data to the image forming section.

The material conveying section includes at least one of material cassette or multi feeder, which can supply sheet materials having types of sizes, a large capacity cassette which can contain a large number of sheet materials and a multi-stage paper conveying device having a plurality of cassettes each contains sheet materials having types of sizes. The material transporting section supplies paper having a desired size to the image forming section.

The image forming section has a photoconductive drum, a developing device, and a copy start switch. The photoconductive drum forms an electrostatic latent image in accordance with image data. The developing device supplies toner to the latent image formed on the photoconductive drum, thereby developing the image. The copy start switch designates the copy start in order to start the image formation. The image forming section forms the image on the document on the paper conveyed by the material conveying section.

In the above copying machine, the large capacity cassette is normally selected as a standard state by initialization.

In some large-sized high speed copying machines, a document size sensor for detecting the size of the document and a function of an automatic magnification selecting mode are provided. For inputting a paper size automatic selection mode for selecting a cassette, which contains paper whose size is conformed to the size of the document, or the large capacity cassette, and magnification for enlargement or reduction, the automatic magnification selecting mode selects the cassette in which paper whose size is defined in accordance with the copy magnification and the document size or the large capacity cassette is selected.

However, for forming an image on the paper whose size is different from the size of the paper contained in the large capacity cassette selected by the initialization, a cassette containing a suitable paper must be newly designated.

Moreover, even if it is obvious that the image is formed on the paper whose size is different from the size of the paper contained in the large capacity cassette and paper is added to the cassette containing the paper having the corresponding size, a cassette in which paper is added must be newly designated.

On the other hand, even if the specific cassette is selected by the paper size automatic selecting mode or the automatic magnification selecting mode, the operation procedure becomes complicated in accordance with the increase in the number of functions of the copying machine when it is required that the image is formed on the paper whose size is the same as the document. In other words, for example, the following operation procedure is required.

The automatic magnification selecting mode is operated to conform to the size of the paper contained in the large capacity cassette regardless of the user's intention. The user cannot judge the size of the document and the the paper having the size which the user wishes to copy is compared with the paper contained in the cassette. Due to this, the paper size automatic selecting mode or the the automatic magnification selecting mode must be released.

Moreover, there is a case that the user does not always understand the size of the paper displayed by A4 or A5. Due to this, there is a problem in that a paper having an erroneous size is selected and an undesirable copying material is provided.

SUMMARY OF THE INVENTION

An object of the present invention relates a copying machine having various functions, and is to provide an image forming apparatus which can form an image on paper having a size which a user wishes to copy.

According to the present invention, there is provided an image forming apparatus, comprising: a plurality of cassette means for storing papers; means for detachably mounting the cassette means; first selecting means for selecting one of the plurality of cassette means; second selecting means, when one of the plurality of cassette means is detached from the mounting means and mounted thereon again, for selecting the containing means is remounted to the holding means, regardless of the selection result of the first selecting means; means for conveying the paper from the cassette means selected by one of the first and second selecting means; and means for forming an image on the paper conveyed by the conveying means.

Moreover, according to the present invention, there is provided an image forming apparatus, comprising: a plurality of cassette means for storing papers; means for detachably mounting the cassette means; first detecting means for detecting that the cassette means is mounted onto the mounting means; second detecting means for detecting whether or not a paper value is stored in each of the cassette means are a predetermined value or over than the predetermined value; first selecting means for selecting one of the plurality of cassette means; second selecting means, when the first detecting means detects that the plurality of cassette means are detached from the mounting means and mounted thereon again, for selecting the cassette means is remounted to the mounting means, regardless of the selection result of the first selecting means; means for conveying the paper from the cassette means selected by one of the first and second selecting means; and means for forming an image on the paper conveyed by the paper conveying means.

Further, according to the present invention, there is provided an image forming apparatus, comprising: a body member; cassette means for storing papers to be formed an image, the cassette means detachably mounted onto the body member; first detecting means for detecting whether a value of the papers stored in the cassette means a predetermined value or less; second detecting means for detecting that the cassette means is detached from the body member and remounted onto the body member when the value of the papers stored in the cassette means is not less than the predetermined value; means for taking out the papers from the cassette means mounted on the body member with respect to the result of the second detecting means; and means for forming an image on the paper taken out by the taking out means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 6 is a pattern view showing an example of an array of the size switch shown in in FIGS. 4 and 5;

DETAILED DESCRIPTION OF THE PREFERRED EMBODIMENT

The present invention will be explained with reference to the drawings.

Figure 1:
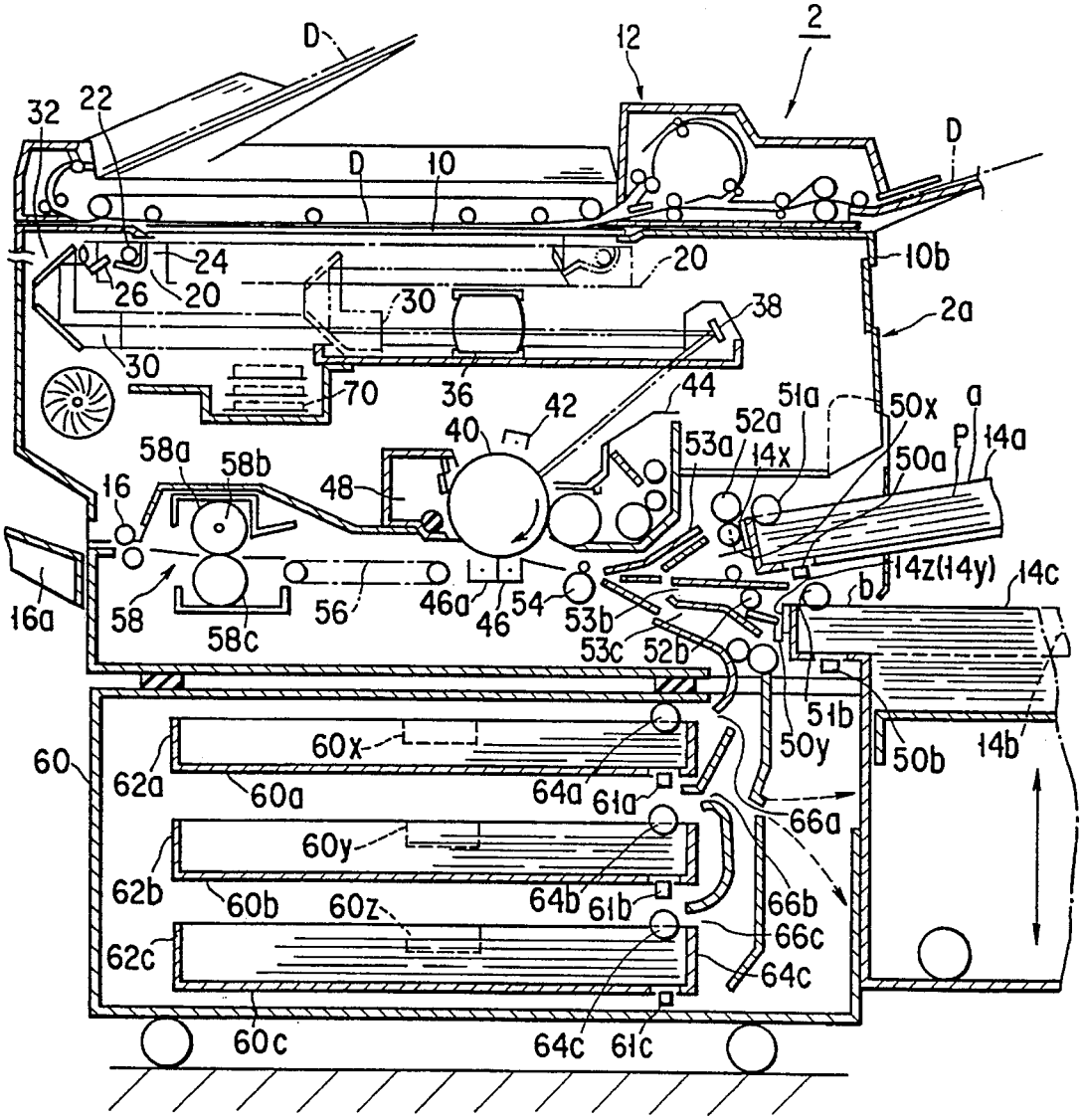
FIG. 1 is a schematic front view showing a copying machine into which one embodiment of the present invention is incorporated.

In FIG. 1, an image forming apparatus, i.e., a copying machine 2 includes a main body 2*a* has a document table 10, a size mark plate 10*a*, a top cover 10*b*, and an auto document feeder (ADF) 12. A document (original) D is mounted on an upper portion of the table 10. The size mark plate 10*a* is provided on one end of the document table 10, and shows the position where the document D is to be mounted. The ADF 12 is formed to be openable and closable to the document table 10. The ADF 12 sequentially feeds the plurality of documents D to the document table 10 one by one, and depresses the fed document D to the document table 10.

Figure 2:
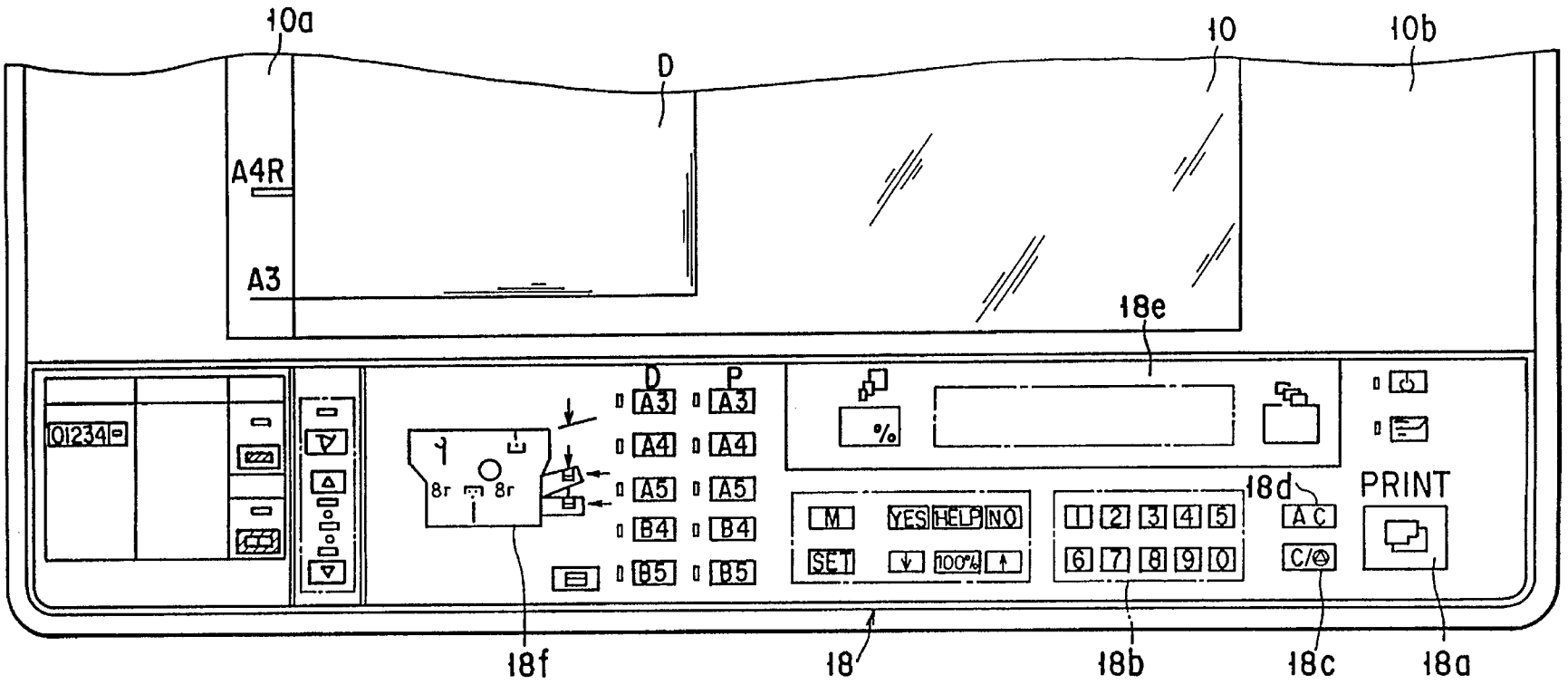
FIG. 2 is a plane view of a console panel, which is incorporated into the copying machine of FIG. 1.

In FIG. 2, on the top cover 10*b*, there is provided a console panel 18 to which a user inputs data for operating the machine 2 such as the number of papers to be copied, a copying magnification or a copy mode for both surfaces, and a print starting signal and a clear signal.

On the console panel 18, there are provided a print start key 18*a*, a ten-key 18*b* for numeric numbers "0" to "9", a clear key 18*c*, and all clear key 18*d*. The print start key 18*a* outputs the print starting signal by the designation of the user. The ten-key 18*b* is used to set the number of papers to be copied or the copying magnification in accordance with the input of the user. The clear key 18*c* outputs a signal for interrupting the copying operation or returning data being inputted to "0." The all clear key 18*d* is used to return all inputs and operations to the initial state.

Moreover, a message display, i.e., liquid crystal display 18*e*, and a monitor LED 18*f* are integrally incorporated into the console panel 18. The liquid crystal display 18*e* can display inputted data (the number of papers to be copied and the copying magnification), an operation procedure of the machine 2, timing for adding copy paper P or toner, and an error message. The monitor LED 18*f* displays the state of the operation of the machine 2, for example, the position of the upper or lower portions of the selected cassette or the position of paper jamming of the machine 2.

Figure 3:
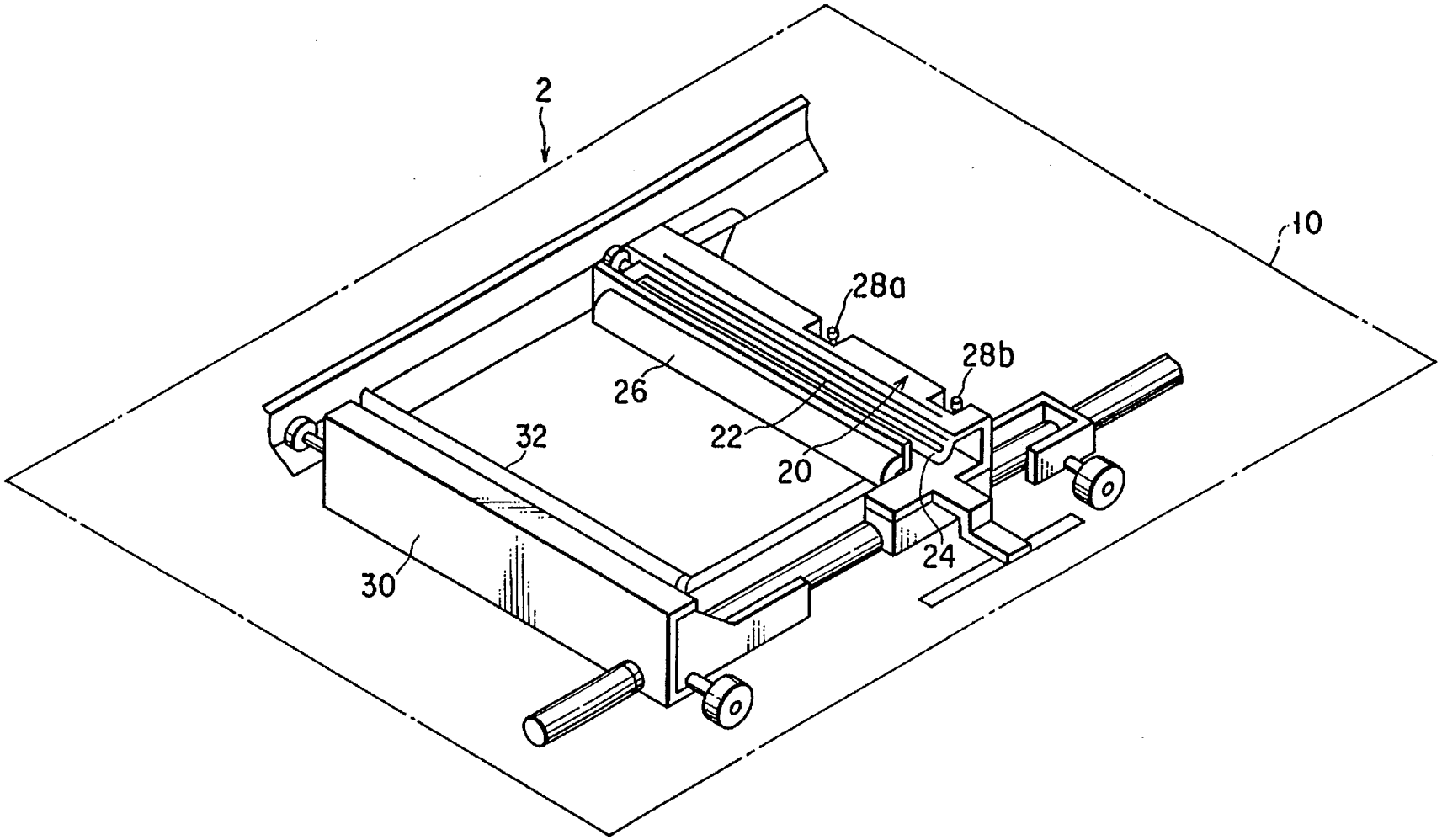
FIG. 3 is a schematically perspective view showing a position of a sensor, which is incorporated into the copying machine of FIG. 1.

In FIG. 3, on the inner side (lower portion) of the document table 10, there are provided an illuminating lamp 22, a reflector 24, and a first carriage 20. The illuminating lamp 22 is used to illuminate document D mounted on the document table 10. The reflector 24 is used to collect illumination light, which is generated by the lamp 22, to the document D. The first carriage 20 is used to reflect a reflected light from the document D to a second carriage 30 (to be explained later).

A first mirror 26 is incorporated into the first carriage 20. The first mirror 26 bends the reflected light from the document D. The first carriage 20 is provided to be movable in parallel with the document 10 by a pulse motor (not shown) through a toothed belt (not shown).

The first carriage 20 has document size detecting sensors 28*a* and 28*b*. The document size detecting sensor 28*a* is located close to the reflector 24 and in the vicinity of the center of the longitudinal direction, and detects the mount of the document D on the document table 10 and the size of the document D. The document size detecting sensor 28*b* is located close to the reflector 24 and at one end of the longitudinal direction. The sensors 28*a* and 28*b* are photo-modulation typed sensors each having a light emitting element (not shown) emitting light of pulse-modulated light and a light receiving element (not shown) responding to the pulse-modulated light emitted from the emitting element. In detecting the size of the document, the sensors 28*a* and 28*b* are formed not to be erroneously operated by external light, which may be inputted from fluorescent lighting.

In the direction where the reflected light bent by the first mirror 26 of the first carriage 20 is transmitted, a second carriage 30, which guides the reflected light from the document D to the photoconductive drum, is provided to follow the first carriage 20. The second carriage 30 is moved in parallel with the document table 10 at a half speed of the first carriage 20 by the toothed belt (not shown) driving the first carriage 20.

Back to FIG. 1, under the first carriage 20, and in the plane including an optical axis of light bent by the second carriage 30, a converging lens 36 and a fourth mirror 38 are provided. The converging lens 36 is formed to be movable by the driving mechanism (not shown). The converging lens 36 provides convergence to the reflected light from the carriage 30, and the reflected light is image-formed at a desired magnification when the lens 36 moves itself. The fourth mirror 38 is used to return the reflected light having the convergence to a photoconductive drum 40 (to be described later), and image-form the reflected light at a desired position of the surface of the photoconductive drum 40. Moreover, in order to correct the variation of a focal distance due to the movement of the lens 36, the fourth mirror 38 is provided to be movable in parallel with the surface where a main light beam is passed. The lens 36 and the mirror 38 are moved by the driving mechanism (not shown), respectively.

Under the lens 36, i.e., in the vicinity of the center of the copying machine 2, there is provided a photoconductive drum 40 on which an electric charge distribution pattern, i.e., an electrostatic image is formed by image-forming the reflected light from the document D guided by the fourth mirror 38.

In the portion around the photoconductive drum 40, there are provided a charging unit 42, a developing unit 44, a transferring unit 46, and a cleaning unit 48 in order. The charging unit 42 charges a predetermined electric charge on the photoconductive drum 40. The developing unit 44 supplies toner to the electrostatic latent image formed on the drum 40, thereby developing the image. The transferring unit 46 transfers the toner image formed on the drum 40 to paper P conveyed from a paper cassette, a large capacity cassette (LCC) and a multi-stage paper feeder (MPF), each explained later. The cleaning unit 48 discharges the drum 40, and removes toner left on the drum 40. In the transferring unit 46, there is provided a separating (AC charge) unit 46a for separating the papers P on which toner image is formed from the drum 40.

In the portion (right side of the machine 2) between the developing unit 44 and the transferring unit 46, there are slots 2*a* and 2*b* to which paper cassettes are inserted (to be explained later). Cassettes 14*a* and 14*b* (shown by a dotted line), each stores a number of sheet materials, which are used to supply the copying papers or transparent sheets to the photoconductive drum 40, are inserted to the slots 2*a* and 2*b*. FIG. 1 shows a state that an LCC 14*c*, which can contain a number of papers, which are several times as compared with the cassettes 14*a* or 14*b*, is mounted onto the slot 2*b*, in place of the cassette 14*b*. Also, at a predetermined position of each of the slots 2*a* and 2*b*, i.e., a position where the residual of the papers contained in the cassettes 14*a* and 14*b* can be detected, paper residual sensors 50*a* and 50*b* of a contact type are provided.

The following will explain the cassette 14*a* and the LCC 14*c*.

Figure 4:
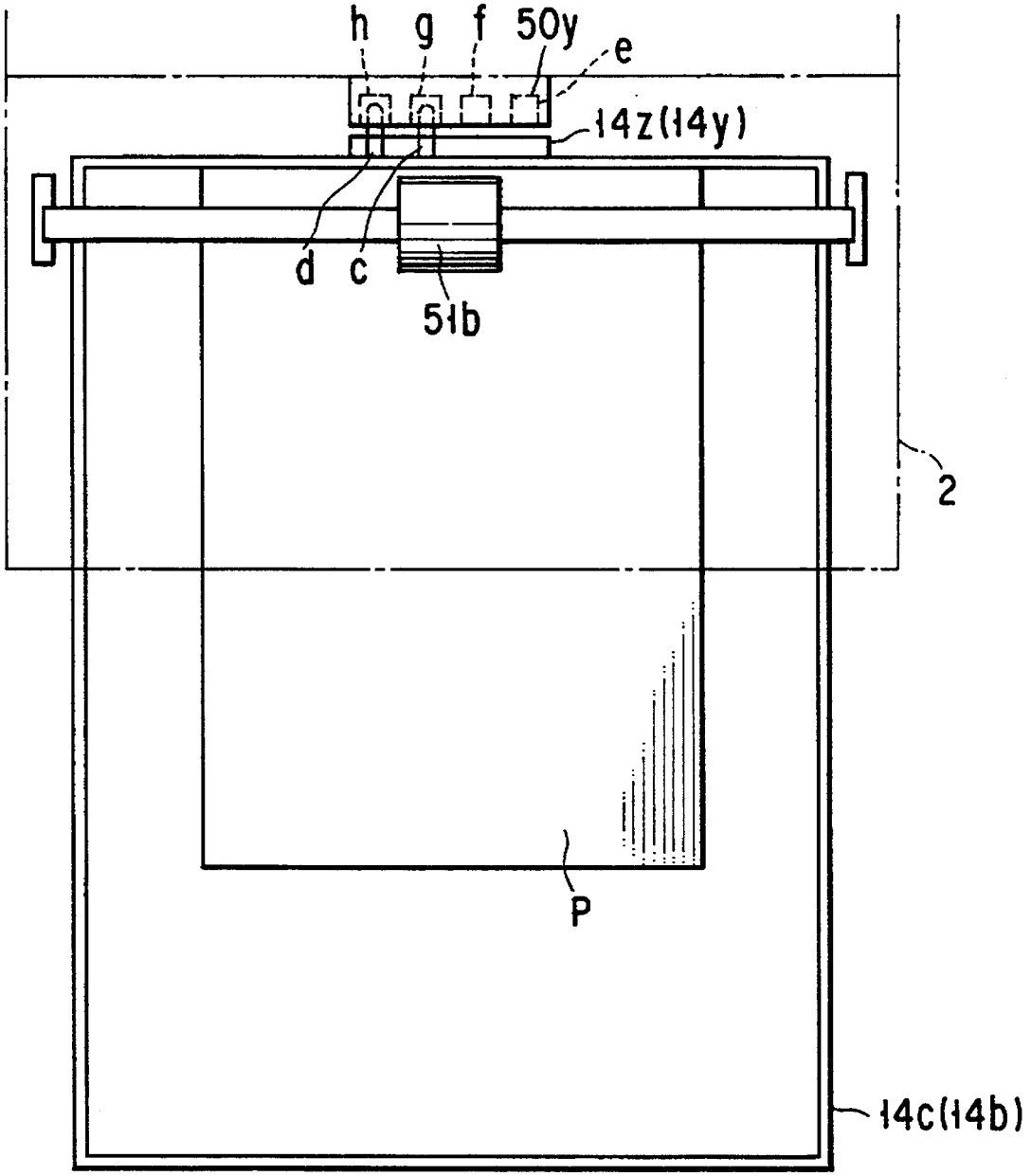
FIG. 4 is a schematically perspective view showing a size switch of a cassette of the copying machine of FIG. 1, and a size detecting switch of a slot.

In the top end portion, which is inserted into the slot, of each of the cassettes 14*a* and LCC 14*c*, a paper size setting sections 14*x* and 14*z* are incorporated so as to input the size of the paper contained in each of the cassette 14*a* and LCC 14*c* to the machine 2 (FIG. 4).

The paper size setting sections 14*x* and 14*z* have a predetermined number (four in this embodiment) of hole positions a, b, c and d where contact makers are provided. The paper size setting sections 14*x* and 14*z* display the size of paper contained inside based on a desired code which displayed an array of contact makers (FIG. 6) defined by the alignment of contact makers α, β, γ, δ (the state of the presence of only γ, δ are shown in FIG. 4) provided in the hole positions a, b, c, and d.

Paper size detecting switches 50*x* and 50*y* are incorporated into the slots 2*a* and 2*b* (FIG. 4). The switches 50*x* and 50*y* detect the size of the papers contained in the cassettes 14*a* and 14*c* through the paper size setting sections when the cassettes 14*a* and 14*c* are inserted in addition to the sensors 50*a* and 50*b*.

The paper size detecting switches 50*x* and 50*y* have detectors e, f, g, and h provided to correspond to hole positions a, b, c, and d of the cassette, and detect the alignment of contact makers α, β, γ, δ arranged at the hole positions a, b, c, and d. Thereby, it is detected that the cassette is mounted and the size of the paper contained in the cassette is determined. The size of the paper contained in each cassette is transmitted to the machine 2 based on the code shown in FIG. 6.

In the inside of the machine 2, and a portion which is among the photoconductive drum 40 and cassette 14*a* and LCC 14*c*, there are provided first and second feed rollers 51*a* and 51*b*, a first and second convey rollers 52*a* and 52*b*, paper paths 53*a* and 53*b*, a connecting paper path 53*c*, and an aligning roller 54.

The first and second feed rollers 51*a* and 51*b* feed paper P one by one from the cassette 14*a* and LCC 14*c*. The first and second convey rollers 52*a* and 52*b* convey paper drawn by the rollers 51*a* and 51*b* to the photoconductive drum 40. Each of the paths 53*a* and 53*b* is formed of a pair of guide plates, and guides paper P to the photoconductive drum 40 from the convey rollers 52*a* and 52*b*. The connecting paper path 53*c* is used to introduce paper P conveyed from the multi-stage paper feeder (MPF) 60 (to be described later). The aligning roller 54 corrects the inclination of paper P, aligns the top end of the image formed on the photoconductive drum 40 with the top end of paper P, and conveys paper P at the same speed as the rotation of the photoconductive drum 40.

In the lower portion of the machine 2, there is provided a multi-stage paper feeder (MPF) 60, which is formed as a different body from the main body of the machine 2, supports the machine 2, and contains a plurality of types of paper cassettes.

The MPF 60 has slots 60*a* to 60*c*, convey rollers 64*a* to 64*c*, and a series of convey paths 66*a* to 66*c*. On the slots 60*a* to 60*c*, cassettes 62*a* to 62*c*, each stores a number of papers, are mounted, respectively. The convey rollers 64*a* to 64*c* draw paper P one by one from the cassettes 62*a* to 62*c* inserted into the slots 60*a* to 60*c*, respectively. Each of the convey paths 66*a* to 66*c*, which is formed of a pair of guide plates, conveys paper P drawn by convey rollers 64*a* to 64*c* to the photoconductive drum 40 included in the copy machine 2.

Paper residual sensors 61*a* to 61*c* and paper size detecting switches 60*x* to 60*z* (FIG. 5) are incorporated into the slots 60*a* to 60*c*, respectively. The paper residual sensors 61*a* to 61*c* detect the presence (residual) of paper P contained in the inserted cassette. The paper size detecting switches 60*x* to 60*z* detect the size of the paper contained in the cassettes 62*a* to 62*c* through paper size setting sections 62*x* to 62*z* when the cassettes 62*a* to 62*c* are inserted.

Figure 5:
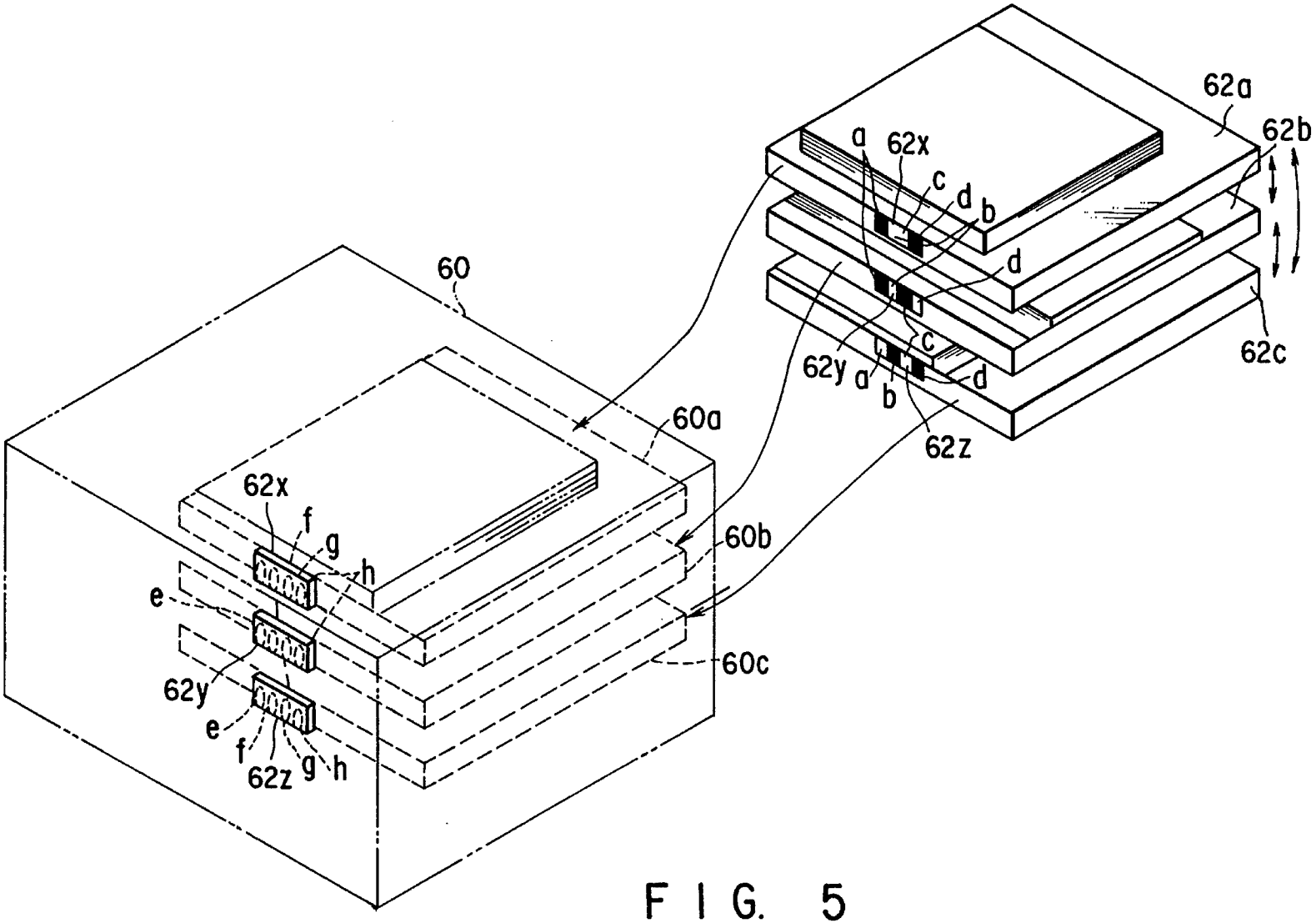
FIG. 5 is a schematically perspective view showing a size switch of a cassette of the multi-stage paper feeder of FIG. 1, and a size detecting switch of a slot.

The paper size detecting switches 60*x* to 60*z* setting sections 14*x* and 14*z* have detectors e, f, g and h provided to correspond to the predetermined number (four in this embodiment) of hole positions a, b, c and d where contact makers (α, β, γ, δ) of the size setting sections 62*z* to 62*z* of the cassettes 62*a* to 62*c*. By detecting the presence (alignment) of the contact makers (α, β, γ, δ) arranged in the hole positions a, b, c, and d of the cassettes, the size of the paper contained in the cassette. In FIG. 5, the contact makers (α, δ), the contact makers (α, γ), and the contact makers (β, δ) are arranged in the cassettes 62*a*, 62*b*, 62*c*, respectively.

The convey paths 66*a* to 66*c* are used to guide paper P from the cassettes 62*a* to 62*c* of the MPF 60 and to convey paper P from the cassette, which is positioned at the lower portion than the cassette, which is selected at the present. For example, the paper P, which is sent from the cassette 66*c* of the lowest stage, is passed through the convey paths 66*c*, 66*b*, and 66*a* in order, and conveyed to the photoconductive drum 40. Also, the convey paths 66*a* to 66*c* can be exposed by detaching the LCC 14*c* mounted onto the slot 2*b*. Moreover, in the convey paths 66*a* to 66*c*, one of the paired guide plates is movable, so that the guide plate can be easily removed even if the paper jamming occurs.

At the left side of the copying machine 2, i.e., a position where paper P on which the toner image is transferred after separating from the photoconductive drum 40 through the transfer unit 46 is conveyed with the rotation of the photoconductive drum 40, there are provided a convey device 56, a fixing device 58, an outputting roller 16, and a discharging tray 16*a*. The convey device 56 conveys paper P to which toner is electrostatically adhered. The fixing device 58 fixes the toner image, which is transferred to paper P, to the paper P. The outputting roller 16 outputs the paper P to which the toner image is fixed to the outer section of the machine 2. The discharging tray 16*a* stocks papers P discharged through the discharging roller 16 in order.

Figure 7:
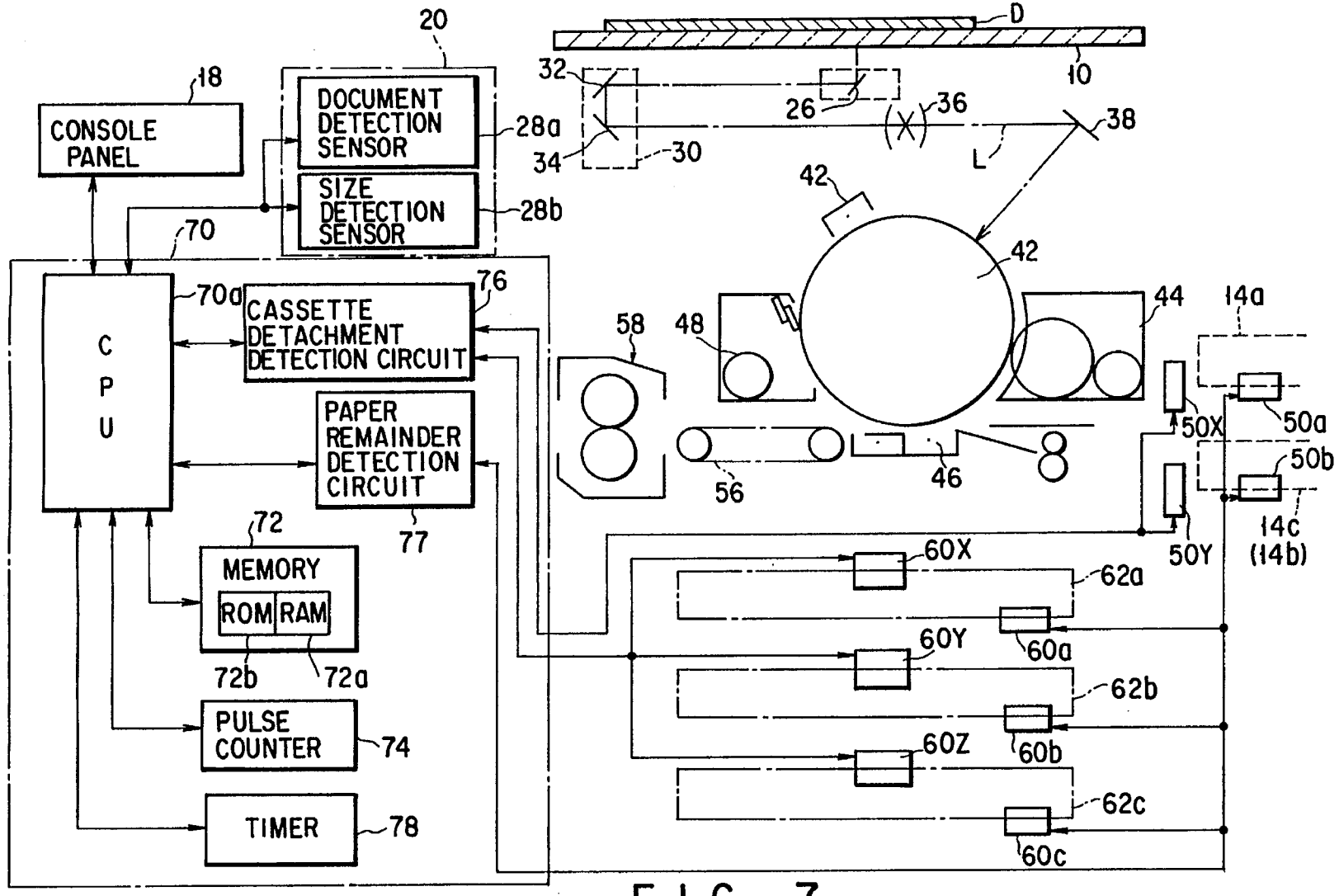
FIG. 7 is a block diagram showing one example of a controller, which is incorporated into the copying machine of FIG. 1.

In FIG. 7, a controller 70 has a CPU 70*a* as a main controller.

A memory 72 (RAM 72*a* and ROM 72*b*), a pulse counter 74, a cassette detachment detecting circuit 76, a paper residual detecting circuit 77, and a timer 78 are connected to to the CPU 70*a*. The memory 72 stores various data for detecting the size of the document D based on detection data inputted by the console panel 18 shown in FIG. 2 and the document size detecting sensors 28*a* and 28*b* shown in FIG. 3. The pulse counter 74 is used to detect the position of the first carriage 20. The cassette detachment detecting circuit 76 detects that the cassette 14*a* (14*b*) or one of the cassettes 62*a* to 62*c* is taken out of the machine 2 or MPF 60 (slot 2*a*, 2*b* and 60*a* to 60*c*) and is inserted again. The paper residual detecting circuit 77 detects whether the residual of paper of each cassette is "0" or the other value based on the outputs of the paper residual sensors 50*a* and 50*b*, and 61*a* to 61*c*. The time 78 counts time of the detachment of one of the cassettes 62*a* to 62*c* from the machine 2 (how long one of the cassettes is detached from the machine 2) or time of passage since a predetermined condition is inputted in order to clear various operation modes within a predetermined time.

The memory 72 has a random access memory (RAM) 72*a* and a read only memory (ROM) 72*b*. The RAM 72*a* stores the position of the first carriage 20 corresponding to the number of pulses outputted from the pulse counter 74. The ROM 72*b* stores identification data for discriminating the size of the document D in accordance with the combination of the outputs from the sensors 28*a* and 28*b* and data obtained by the pulse counter 74.

The pulse counter 74 counts the number of pulses supplied to a pulse motor for a carriage movement (not shown). The number of pulses counted by the counter 74 is compared with data showing the length of the document D stored in the ROM 72*b* so as to detect the length of the document D.

The cassette detachment detecting circuit 76 detects that the cassette 14*a* (or 14*b*) or LCC 14 and cassettes 62*a* to 62*c* are inserted to the respective slots by the paper size detecting switch incorporated into the slots 2*a*, 2*b*, and slots 60*a* to 60*c* of the MPF 60.

The paper residual detecting circuit 77 detects whether the residual of paper of each of the cassettes 14*a* (14*b*) inserted to each slot or LCC 14*c* and cassettes 62*a* to 62*c* is a predetermined value, for example, "0" or the other value based on the outputs of the paper residual sensors 50*a* and 50*b*, and 61*a* to 61*c*, which are respectively provided in the slots 2*a*, 2*b*, and 60*a* to 60*c*. In the case that the cassette whose residual of paper is 0 is detected, the detected cassette is inserted to the slot is inputted to the RAM 72*a* via CPU 70*a*.

The timer 78 is used to count standby time for auto-clear. For example, a fixed time N [second] (e.g., N=30) since one of the cassettes 62*a* to 62*c* is detached from the machine 2 or a predetermined condition is inputted.

Next, the operation of the copying machine 2 of the present invention will be explained.

Figure 8:
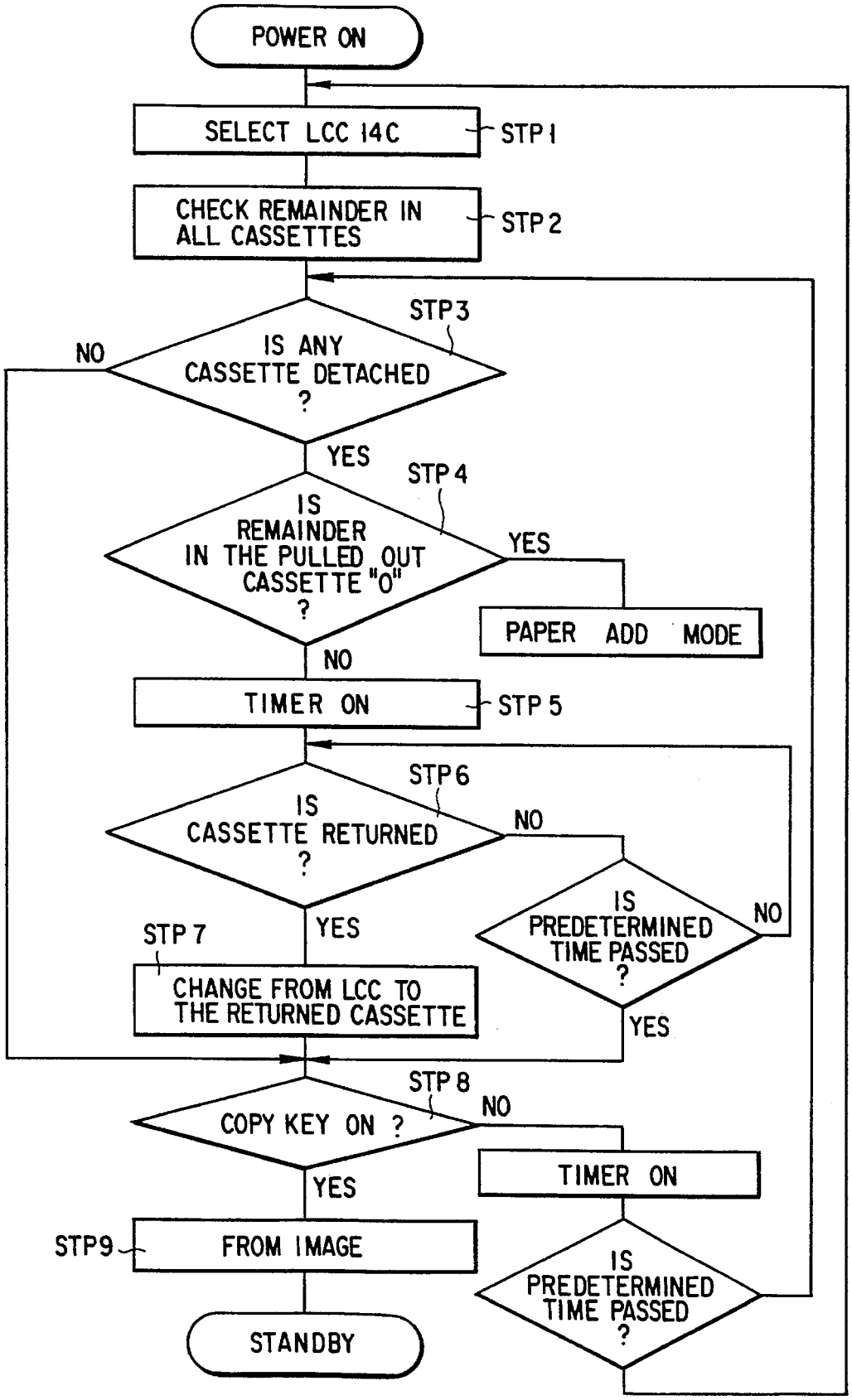
FIG. 8 is a flow chart showing the operation of the embodiment of the present invention.

In FIG. 8, a power switch (not shown) of the copying machine 2 is turned on, so that the photoconductive drum 40, charging unit 42, developing unit 44, and fixing device 58 are initialized.

At this time, LCC 14*c*, serving as a paper supplying medium, is selected, and a standby state is defined (STP1).

The print start key 18*a* is turned on, so that the presence of paper P contained in each of the cassette 14*a*, LCC 14*c*, and cassettes 62*a* to 62*c* is checked by the sensors 50*a*, 50*b*, 61*a* to 61*c*. In the case that the cassette whose residual of paper is 0 is detected, the detected cassette is stored in the RAM 72*a* (STP2).

The paper size detecting switch of each slot to which each cassette is inserted detects whether or not the cassettes 14*a* and one of cassettes 62*a* to 62*c* are taken out of the machine 2 or MPF 60 (STP3).

It is discriminated whether or not the residual of paper of the cassette taken out of the machine 2 in step STP3 is 0 based on data stored in RAM 72*a* (STP 4). In the case that the cassette whose residual of paper is 0 is taken out of the machine 2 (STP4-YES), the paper add mode is set. In this case, the LCC 14*c* selected in step STP1 is maintained as the paper supply medium. On the other hand, in the case that the residual of paper of the cassette is a value other than "0" (STP4-NO), the timer 78 is started (STP5). Then, the paper size detecting switch of each slot detects whether or not the cassette is returned to the slot from which the cassette is already taken (STP6). In the case that the cassette is returned within the predetermined time N (STP6-YES), the cassette, which is returned from LCC 14*c*, is used as the paper supply medium by CPU 70*a* (STP7). In the case that the timer 78 started in step 5 counts the predetermined time N, the LCC 14*c* selected in STP1 is maintained as the paper supply medium (STP6-NO).

The cassette, serving as the paper supply medium, is defined in step STP7, so that the timer 78 is turned on again (STP8). Then, in the case that the print key 18*a* is turned on by the time that the predetermined is passed, the image forming operation is started (STP8-YES).

In other words, the photoconductive drum 40 is rotated at a predetermined rotation speed and a predetermined potential is applied thereto by the charging unit 42. Then, the illumination light 22 of the first carriage 20 is turned on, and the document D is illuminated by light from the lamp 22 and reflected light by the reflector 24. The reflected light from the document D is image-formed at a predetermined position of the photoconductive drum 40 via the first mirror 26, second mirror 32, third mirror 34, lens 36, and fourth mirror 38. Thereby, data of the document D is converted to the electrostatic latent image by the photoconductive drum 40.

The electrostatic latent image on the photoconductive drum 40 is guided to the developing area opposite to the developing unit 44 with the rotation of the photoconductive drum 40. Then, toner is selectively supplied to the latent image, and the image is developed by the developing unit 44.

The developed toner image on the photoconductive drum 40 is transferred to the transfer area opposite to the transferring unit 46 with the rotation of the photoconductive drum 40.

At the same time with the above-mentioned series of operations, one paper P conveyed from the selected cassette is transferred to the transferring area formed between the photoconductive drum 40 and the transferring unit 46. In other words, paper P is drawn by one of the paper conveying rollers 51*a*, 51*b*, 64*a*, 64*b*, and 64*c*, which are provided to correspond to the cassettes 14*a*, 14*b*, or LCC 14*c* or MPF 60. Moreover, paper P is guided via the path formed by the convey roller 53*a* and the passage 54*a* or the convey roller 53*b* and the passage 54*b*.

The drawn paper P is once stopped by the aligning roller 55, and conveyed to the photoconductive drum 40 based on the movement of either the first carriage 20 or the second carriage 30, that is, alignment of the top end of the image with the top end of paper P.

The electrical charge, which has the same polarity as the electrical charge already applied to the photoconductive drum 40, is supplied from the transferring unit 46 to the photoconductive drum 40 on which the toner image is formed. Therefore, the toner image on the photoconductive drum 40 is transferred to the paper P.

The paper P to which the toner image is transferred is released from the adhesion to the photoconductive drum 40 by the AC voltage from the separating charge unit 46*a*, which is integrally formed in the transferring unit 46, and sent to the convey device 56 in a state that toner is mounted thereon.

On the other hand, the photoconductive drum 40 from which the paper P and the tone image are separated is further rotated, and returned to the initial state by the cleaning unit 48 to be used for the next image formation.

The paper P on which the toner image is formed is guided to the fixing device 58 by the convey device 56. The fixing device 58 fixes the toner image to the paper P since toner having a thermally melting property is melted.

The paper P on which the image of the document is formed is discharged to the outer unit of the machine 2 by the discharge roller 16, and stocked in the discharge tray 16*a* shown in FIG. 1 in a state that the image-formed face is out (STP9).

On the other hand, in the case that the timer 78 is turned on in step 8 and the print key 18*a* is not turned on within the predetermined time, the cassette defined in step 7 is returned to the LCC 14*c* defined by the initial operation (STP8-NO).

As mentioned above, according to the copying machine of the present invention, if one of the plurality of paper conveying means is taken out of the main body of the apparatus and turned to the original position, the returned paper conveying means is automatically selected. In the case that the cassette is taken out of the main body of the apparatus and the residual of the paper of the cassette is checked for the copying operation for the large number of papers or the case that the cassette is taken out of the main body of the apparatus for visually confirming the size of the paper, the operability of the copying machine can be improved since the cassette is returned to the main body of the apparatus and it is selected that the paper supply is performed by the returned cassette.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus, comprising:

a plurality of cassette means for storing papers;

means for detachably mounting said cassette means;

first selecting means for selecting one of said plurality of cassette means;

second selecting means, when one of said plurality of cassette means is detached from said mounting means and remounted thereon again, for selecting said remounted cassette means, regardless of the selection result of said first selecting means;

means for conveying the paper from said cassette means selected by one of said first and second selecting means;

means for detecting whether the residual of the papers stored in each of said cassette means is a predetermined value or more;

means for controlling said conveying means; and wherein said controlling means maintains the previous state as if said cassette means is not detached from said mounting means regardless of the selection result of said second selecting means when said detecting means detects that the residual of the paper is the predetermined value before the remounted cassette means is detached from said mounting means; and means for forming an image on the paper conveyed by said conveying means.

2. An image forming apparatus comprising:

a plurality of cassette means for storing sheets;

means for detachably mounting said cassette means;

first selecting means for selecting one of said plurality of cassette means;

second selecting means, when one of said plurality of cassette means is detached from said mounting means and remounted back to said mounting means, for selecting said cassette means which is remounted to said mounting means, regardless of the results of the selection of said first selecting means;

means for conveying a sheet from said cassette means selected by one of said first and second selecting means;

means for forming an image on the sheet conveyed by said conveying means;

means for detecting a quantity of residual sheets stored in each of said plurality of cassette means; and means for preventing said second selecting means from selecting said remounted cassette means when said detecting means detects that said quantity of the residual sheets stored in said remounted cassette means is less than a predetermined value.

3. An image forming apparatus comprising:

a plurality of cassettes for storing sheets;

means for detachably mounting said cassettes;

first selecting means for selecting one of said plurality of cassettes;

second selecting means, when one of said plurality of cassette means is detached from said mounting means and remounted back to the mounting means, for selecting the cassette means which is remounted to said mounting means, regardless of the current selection of said first selecting means;

means for conveying a sheet from said cassette selected by one of said first and second selecting means;

means for forming an image on the sheet conveyed by said conveying means;

means for counting the time during which said cassette means is detached from said mounting means; and means for preventing said second selecting means from selecting said remounted cassette when the time it is detached is longer than a predetermined reset time of the image forming apparatus.

* * * * *